US007965040B2

(12) United States Patent
Iwasaki et al.

(10) Patent No.: US 7,965,040 B2
(45) Date of Patent: Jun. 21, 2011

(54) PLASMA DISPLAY PANEL COMPRISING ENHANCED DISCHARGE ON UNIT LIGHT EMISSION AREA

(75) Inventors: Shingo Iwasaki, Tokyo (JP); Yoshihiko Kamo, Tokyo (JP); Jiro Fujimori, Tokyo (JP)

(73) Assignee: Panasonic Corporation, Kadoma (JP)

( * ) Notice: Subject to any disclaimer, the term of this patent is extended or adjusted under 35 U.S.C. 154(b) by 364 days.

(21) Appl. No.: 12/119,051

(22) Filed: May 12, 2008

(65) Prior Publication Data

US 2008/0315765 A1 Dec. 25, 2008

(30) Foreign Application Priority Data

Jun. 25, 2007 (JP) ..... 2007-166599

(51) Int. Cl.
*H01J 17/49* (2006.01)

(52) U.S. Cl. ..... 313/583; 313/582; 313/586

(58) Field of Classification Search ..... 313/582–587; 315/169.1, 169.4; 345/37, 41, 60, 71
See application file for complete search history.

(56) References Cited

U.S. PATENT DOCUMENTS

| | | | | |
|---|---|---|---|---|
| 6,348,762 | B1 * | 2/2002 | Nunomura et al. | 313/582 |
| 6,479,932 | B1 * | 11/2002 | Nunomura | 313/582 |
| 6,549,180 | B1 * | 4/2003 | Yoo et al. | 345/60 |
| 6,630,788 | B1 * | 10/2003 | Park | 313/582 |
| 6,700,323 | B2 * | 3/2004 | Amemiya | 313/582 |
| 7,088,314 | B2 * | 8/2006 | Harada et al. | 345/60 |
| 7,759,867 | B2 * | 7/2010 | Kim et al. | 313/584 |
| 2004/0155267 | A1 * | 8/2004 | Harada et al. | 257/258 |
| 2007/0114933 | A1 * | 5/2007 | Kim et al. | 313/582 |
| 2007/0200502 | A1 * | 8/2007 | Kang et al. | 313/582 |

* cited by examiner

*Primary Examiner* — Nimeshkumar D Patel
*Assistant Examiner* — Jose M Diaz
(74) *Attorney, Agent, or Firm* — Arent Fox LLP

(57) ABSTRACT

Each of the red, green and blue column electrodes has widened portions each having a row-direction width larger than that of the other portions. Each of the widened portions faces a head portion of each of the transparent electrodes of a pair of row electrodes constituting each row electrode pair. The widened portion of the green column electrode facing the green discharge cell provided with the green phosphor layer is located in a different position in the column direction from a position of each of the widened portions of the red and blue column electrodes respectively facing the red and blue discharge cells respectively provided with the red and blue phosphor layers.

5 Claims, 5 Drawing Sheets

*FIRST EMBODIMENT*

FIRST EMBODIMENT

SECTION III – III

SECOND EMBODIMENT

THIRD EMBODIMENT

PLASMA DISPLAY PANEL COMPRISING ENHANCED DISCHARGE ON UNIT LIGHT EMISSION AREA

BACKGROUND OF THE INVENTION

1. Field of the Invention

This invention relates to structure of surface-discharge-type alternating-current plasma display panels.

The present application claims priority from Japanese Application No. 2007-166599, the disclosure of which is incorporated herein by reference.

2. Description of the Related Art

FIG. 1 is a front view illustrating the structure of a conventional surface-discharge-type alternating-current plasma display panel. A surface-discharge-type alternating-current plasma display panel is hereinafter abbreviated as "PDP".

In FIG. 1, the conventional PDP comprises a plurality of row electrode pairs (X, Y) provided on the front glass substrate and a plurality of column electrodes D(R), D(G), D(B) provided on the back glass substrate which face the front glass substrate across the discharge space S. The column electrodes D(R), D(G), D(B) respectively intersect with the row electrode pairs (X, Y) such that discharge cells C are formed in the discharge space S corresponding to the respective intersections. Each of the face-to-face row electrodes X and Y constituting each of the row electrode pairs (X, Y) is made up of T-shaped transparent electrodes Xa (Ya) formed of a transparent conductive film such as an ITO film and a metal-film-formed bus electrode Xb (Yb) which extends in the row direction and is connected to the base ends of the transparent electrodes Xa (Ya).

Each of the column electrodes D(R), D(G), D(B) faces the transparent electrodes Xa and Ya which face and are paired with each other across a discharge gap g.

The column electrodes D(R), D(G) and D(B) respectively have widened portions D(R)a, D(G)a and D(B)a each formed in a portion corresponding to the head end of the transparent electrode Ya. The widened portions D(R)a, D(G)a, D(B)a have a row-direction width greater than those of the respective other portions of the column electrodes D(R), D(G), D(B). Each of the column electrodes D(G) faces the discharge cells C in which green phosphor layers are respectively provided. The row-direction width of the widened portion D(G)a of the column electrode D(G) is set greater than those of the widened portions D(R)a and D(B)a of the column electrodes D(R) and D(B) which respectively face the discharge cells C with red and blue phosphor layers respectively provided therein.

A PDP having such a conventional structure is disclosed in Japanese Unexamined Patent Publication No. 2003-16944.

This conventional PDP has the advantage of offering stable discharge characteristics. This is because, when an address discharge which is an opposing discharge is initiated through the phosphor layers interposed between the head end of the transparent electrode Ya of the row electrodes Y and the corresponding column electrode D(R), D(G) or D(B) in each discharge cell, the widened portion D(R)a, D(G)a or D(B)a of the column electrode D(R), D(G) or D(B) causes the address discharge to occur with a concentration on the head end of the transparent electrodes Ya facing the widened portion.

In the conventional PDP, a discharge does not easily occur through the green phosphor layer, so that the column electrode D(G) disposed facing the discharge cells C in which the green phosphor layers are provided has widened portions D(G)a each having a greater row-direction width than that of each of the widened portions of the other column electrodes D(R), D(B). This difference in size of the widened portions prevents the discharge characteristics from being varied by the difference among the phosphor materials forming the respective phosphor layers provided in the discharge cells C. In consequence, the conventional PDP additionally has the ability of uniformly producing the address discharge in the discharge cells, thus expanding the voltage margin.

However, the row-direction width of each discharge cell C is increasingly reduced along with the higher definition image because of the development of PDPs such as a full HD PDP in recent years. Accordingly, as in the conventional PDP, when a widened portion is provided in the column electrode and the widened portion of a column electrode facing a discharge cell in which a phosphor layer of a required color is formed has a greater row-direction width than that of another widened portion of another column electrode facing a discharge cell in which a phosphor layer of a different color is formed, the opposing ends of the greater widened portion of the column electrode may possibly overlie a part of a partition wall unit P partitioning the discharge space into the discharge cells as shown in FIG. 1.

The conventional structure of the PDP as described above may possibly have the disadvantages of causing an increase in the electrostatic capacity caused between the row electrode and the column electrode by the partial overlie between the column electrode and the partition wall unit, and of a rise in the discharge voltage during the address discharge, and the like.

SUMMARY OF THE INVENTION

It is a technical object of the present invention to solve the problems associated with the conventional PDP as described above.

To attain this object, the present invention provides a plasma display panel which comprises: a front substrate and a back substrate facing each other across a discharge space; a plurality of row electrode pairs each extending in a row direction and arranged in column direction on a rear-facing face (the inner face) of the front substrate, each of the row electrode pairs being constituted of a pair of row electrodes facing each other across a discharge gap; a plurality of column electrodes each extending in the column direction and arranged in the row direction on a face of the back substrate facing the front substrate, and forming unit light emission areas in the discharge space in positions respectively corresponding to intersections with the row electrode pairs; and phosphor layers respectively provided in the unit light emission areas for emitting light of different colors. Each of the column electrodes has widened portions of a row-direction width larger than that of the other portions. Each of the widened portions faces a head portion of one of the pair of row electrodes constituting each row electrode pair, the head portion facing the other row electrode with the discharge gap in between. The widened portion of the column electrode, that faces the unit light emission area of the unit light emission areas in which the phosphor layer emitting light of a required color is provided, is located in a different position in the column direction from a position of another widened portion of another column electrode facing another unit light emission area in which the phosphor layer is provided for emitting light of a different color from the required color.

A PDP of an embodiment, which illustrates the best mode presently contemplated by the inventors for practicing the invention, comprises: a front substrate and a back substrate facing each other across a discharge space; a plurality of row electrode pairs each extending in a row direction and arranged in column direction on a rear-facing face (the inner face) of the front substrate, each of the row electrode pairs being constituted of a pair of row electrodes facing each other across a discharge gap; a plurality of column electrodes each extending in the column direction and arranged in the row direction on a face of the back substrate facing the front substrate, and forming unit light emission areas in the discharge space in positions respectively corresponding to intersections with the row electrode pairs; and phosphor layers respectively provided in the unit light emission areas for emitting light of different colors. Each of the column electrodes has widened portions of a row-direction width larger than that of the other portions.

Each of the widened portions faces a head portion of one of the pair of row electrodes constituting each row electrode pair, the head portion facing the other row electrode with the discharge gap in between. The widened portion of the column electrode, that faces the unit light emission area of the unit light emission areas in which the phosphor layer emitting light of a required color is provided, is located in a different position in the column direction from a position of another widened portion of another column electrode facing another unit light emission area in which the phosphor layer is provided for emitting light of a different color from the required color.

In the PDP of the embodiment, the widened portions are provided on each of the column electrodes. Because of this, the column electrode has an increased opposing area to the head end of one of the row electrode pair facing the other row electrode with the discharge gap in between. For this reason, in the operation of the PDP, when an address discharge is initiated between one of the paired row electrodes and the column electrode, the occurrence of the address discharge is concentrated on a central portion of the unit light emission area corresponding to the discharge gap between the row electrodes, so that the discharge generation region is prevented from expanding to the inner peripheral area of the unit light emission area, resulting in stable discharge characteristics.

In addition, the phosphor layers of different colors, for example, the red, green and blue phosphor layers are respectively provided in the unit light emission areas. An address discharge occurs through the phosphor layer interposed between the row and column electrodes. Then, when one of the phosphor layers having a required color, for example, the green phosphor layer for emitting green light, is formed of phosphor materials that make the occurrence of the address discharge less likely than the phosphor layers for emitting light of the other colors make, the widened portion of the column electrode facing the unit light emission area in which the phosphor layer for emitting the required color light is provided is located in a different position in the column direction from the position of another widened portion of the column electrode facing another unit light emission area in which the phosphor layer is provided for emitting light of a different color from the required color.

Accordingly, the widened portion of the column electrode, which faces the unit light emission area equipped with the phosphor layer emitting light of the color making the occurrence of the address discharge less likely, can be located in a position allowing the address discharge to occur more readily than the widened portion of the column electrode facing the unit light emission areas for the other color light emission. In consequence, the discharge voltage during the address discharge initiated in the unit light emission area in which the phosphor layer making the occurrence of the address discharge less likely is reduced to be approximately equal to the discharge voltage in the other unit light emission areas for the other color light emission. In consequence, the discharge characteristics are equalized in the respective unit light emission areas, thus reliably achieving an enhancement in voltage margin of the panel.

In the PDP in the embodiment, the widened portion of the column electrode facing the unit light emission area in which the phosphor layer emitting the light of the required color, for example, a green light, is provided is preferably located closer to a position facing a center of the unit light emission area in the column direction than a position of the widened portion of the column electrode in the unit light emission area in which the phosphor layer emitting light of a different color, for example, the red or blue light, is provided, and the widened portion preferably has a larger area facing the discharge gap than an area of the widened portion facing the unit light emission area in which the phosphor layer emitting the different color is provided faces the discharge gap.

As a result, the discharge voltage during the address discharge in the unit light emission area in which the phosphor layer making the occurrence of the address discharge less likely is provided is further reduced, thus facilitating approximate equalization of the discharge voltages in the unit light emission areas for emitting light of different colors.

In the PDP of the embodiment, when the discharge characters related to the phosphor layers are varied depending on the color light, for example, red, green and blue light, emitted from the phosphor materials forming the phosphor layers, the position of the widened portion of the column electrode in the column direction is preferably determined depending on which color light the widened portion faces the unit light emission area provided with the phosphor layer emitting. For example, as the column electrode faces the unit light emission area provided with the phosphor layer formed of phosphor materials that make it more and more difficult for an address discharge to occur through the phosphor layer between the row electrode and the column electrode, the widened portion of the column electrode is preferably located closer and closer to a position facing the center of the unit light emission area. In other words, for example, when the column electrodes are disposed corresponding to the unit light emission areas respectively provided with the green phosphor layer, the red phosphor layer and the blue phosphor layer, based on this color order, the position of the widen portion is preferably determined closer to the position facing the center of the unit light emission area.

As a result, the less likely the address discharge occurs in the unit light emission area, the greater the reduction in discharge voltage during the address discharge in the unit light emission area, thus further facilitating the equalization of the discharge voltages in the unit light emission areas from which, for example, red, green and blue lights are respectively emitted.

In the PDP of the embodiment, the column-direction width of the widened portion of the column electrode, which faces the unit light emission area provided with the phosphor layer emitting light of a required color, for example, green light is provided, is set larger than the column-direction width of the widened portion of the column electrode which faces the unit light emission area provided with the phosphor layer emitting light of a different color from the required color, for example, red or blue light, is provided.

As a result, the area of the widened portion of the column electrode facing the unit light emission area in which the phosphor layer is provided for emitting light of a required color can be set effectively larger than the area of the widened portion of the column electrode facing the unit light emission area in which the phosphor layer is provided for emitting light of a different color from the required color. Because of this, the PDP is capable of advantageously reducing the discharge voltage during the address discharge occurring in the unit light emission area in which the phosphor layer is provided for emitting light of a required color, to a level equal to the discharge voltage during the address discharge occurring in the unit light emission area in the phosphor layer is provided for emitting light of a different color from the required color. As a result, when the increasing advance of high-definition-image technology such as so-called full HD involves a reduction in the area of each discharge cell, even in a PDP comprising a partition wall unit blocking the adjacent unit light emission areas in the row direction from each other, it is possible to avoid the partial overlie between the row-direction opposing ends of the widened portion of the column electrode and the partition wall unit. This makes it possible to prevent an increase in the electrostatic capacity between the row electrode and the column electrode and the elimination of the effect of reducing the discharge voltage which are caused by the partial overlie between the widened portion of the column electrode and the partition wall unit as occurs in a conventional PDP.

In the PDP of the embodiment, the column-direction width of the widened portion of the column electrode is preferably determined depending on which color light the widened portion faces the unit light emission area provided with the phosphor layer emitting. For example, as the column electrode faces the unit light emission area provided with the phosphor layer formed of phosphor materials that make it more and more difficult for an address discharge to occur through the phosphor layer between the row electrode and the column electrode, the column-direction width of the widened portion of the column electrode becomes preferably longer. In other words, for example, when the column electrodes are disposed corresponding to the unit light emission areas respectively provided with the green phosphor layer, the red phosphor layer and the blue phosphor layer, based on this color order, the column-direction width of the widen portion is preferably determined to become longer.

In consequence, the less likely the phosphor layer in the unit light emission area makes address discharge occur, the greater the reduction in discharge voltage during the address discharge in the unit light emission area, thus further facilitating the equalization of the discharge voltages in the unit light emission areas from which, for example, red, green and blue lights are respectively emitted.

These and other objects and features of the present invention will become more apparent from the following detailed description with reference to the accompanying drawings.

DETAILED DESCRIPTION OF THE PREFERRED EMBODIMENTS

First Embodiment

Figure 1:
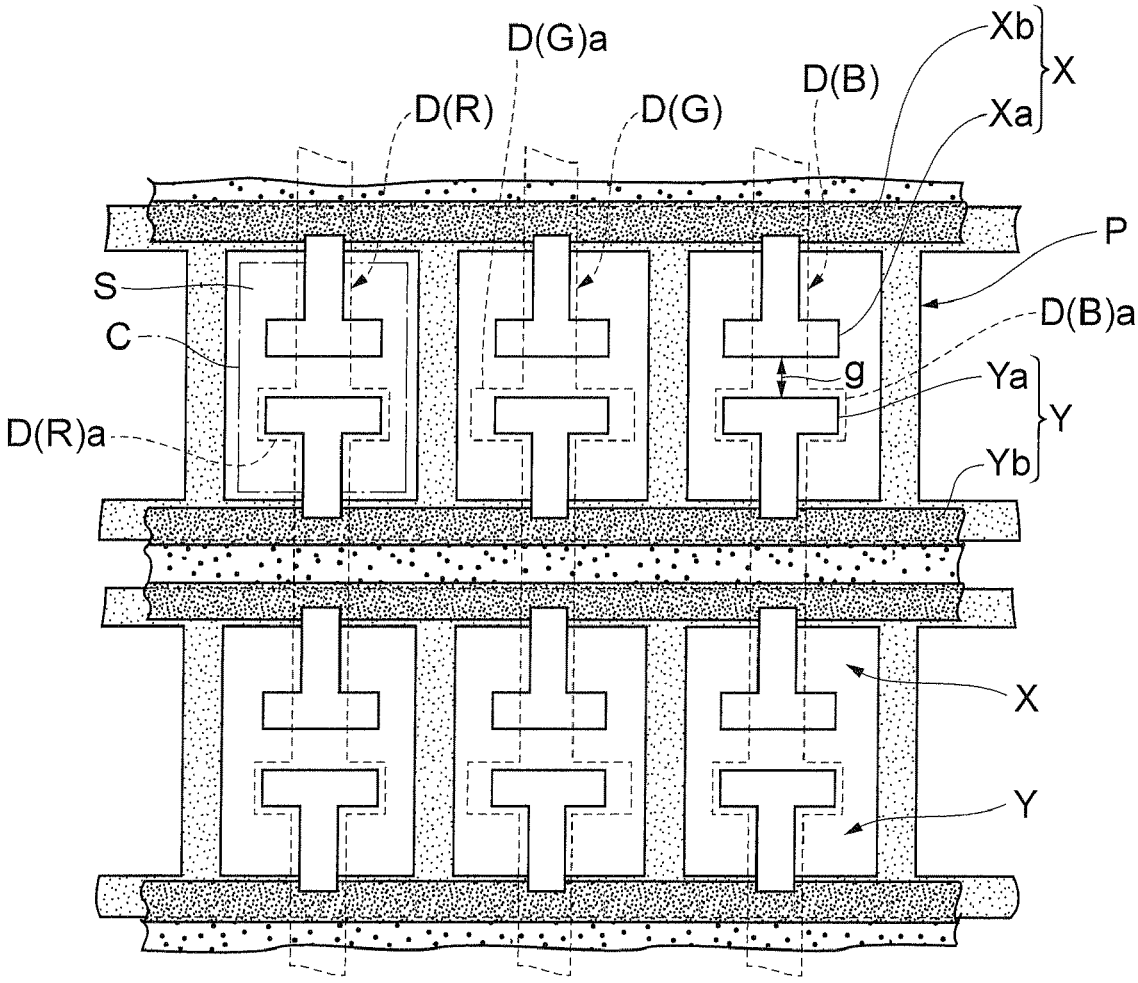
FIG. 1 RELATED ART
FIG. 1 is a front view illustrating an example of a conventional PDP.
Figure 2:
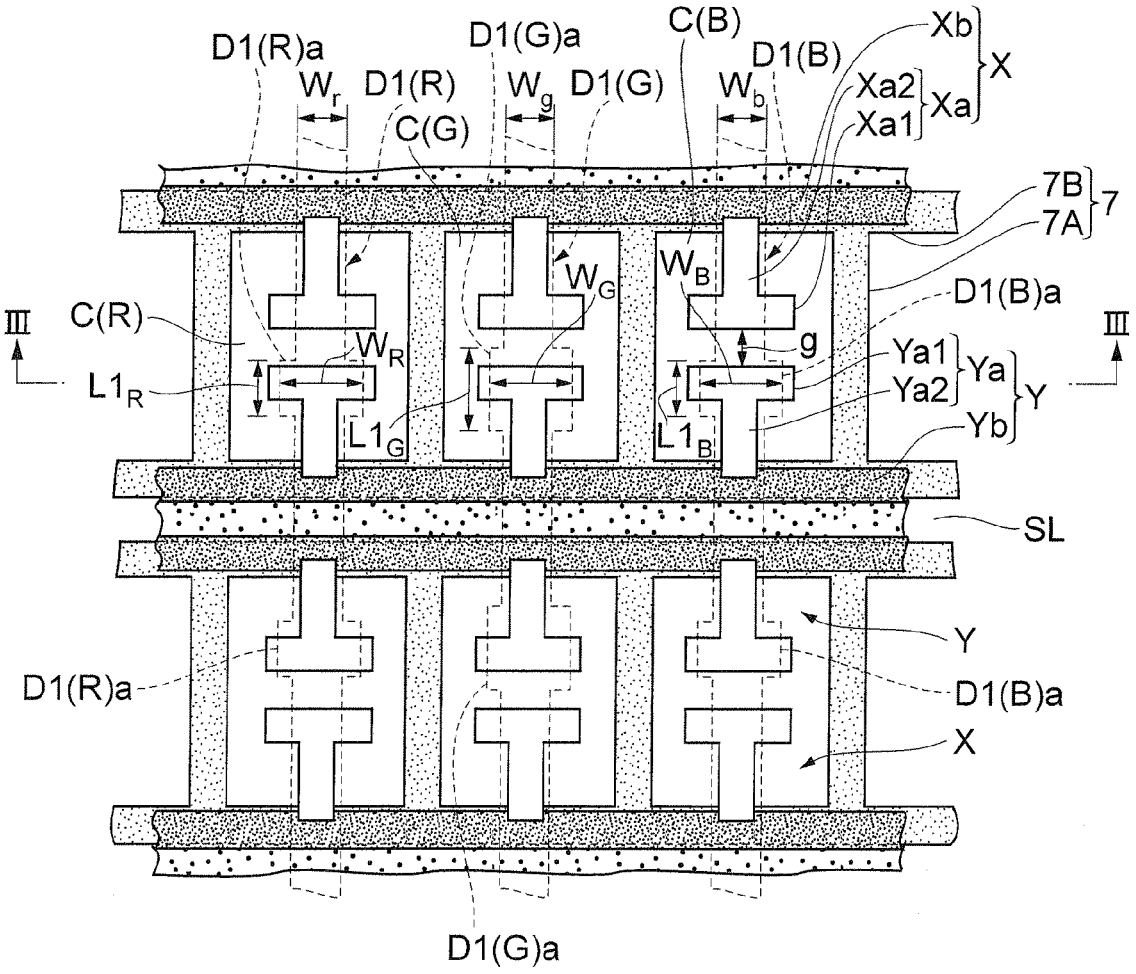
FIG. 2 is a front view illustrating a first embodiment of a PDP according to the present invention.
Figure 3:
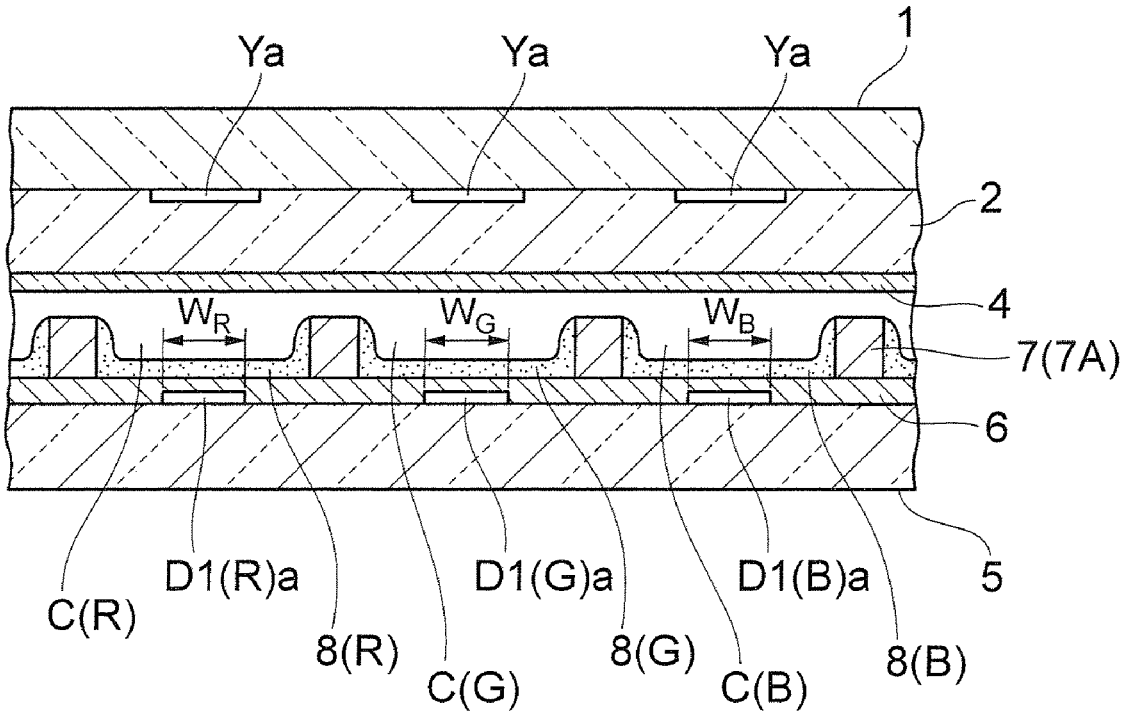
FIG. 3 is a sectional view taken along the III-III line in FIG. 2.

FIGS. 2 and 3 illustrate a first embodiment of preferred embodiments of the PDP according to the present invention. FIG. 2 is a schematic front view of the PDP of the first embodiment.

FIG. 3 is a sectional view taken along the III-III line in FIG. 2.

In FIGS. 2 and 3, a plurality of row electrode pairs (X, Y), which are provided on the inner face (facing the rear of the PDP) of the front glass substrate 1 which serves as the display surface of the PDP, each extend in the row direction (the right-left direction in FIG. 2) and are arranged parallel to each other in the column direction (the up-down direction in FIG. 2).

Each of the face-to-face row electrodes X, Y constituting each of the row electrode pairs (X, Y) is composed of a plurality of T-shaped transparent electrodes Xa (Ya) and a metal-film-formed bus electrode Xb (Yb) extending in the row direction of the front glass substrate 1. Each of the T-shaped transparent electrodes Xa (Ya) is made up of a widened head end Xa1 (Ya1) and a narrow base end Xa2 (Ya2) connected to the bus electrode Xb (Yb). The transparent electrodes Xa (Ya) are spaced equally from each other along the bus electrode Xb (Yb). In each row electrode pair (X, Y), the head ends Xa1 and Ya1 of the respective transparent electrodes Xa and Ya face each other across a predetermined discharge gap g to pair up with each other.

The row electrodes X and Y in a row electrode pair (X, Y) are positioned in reverse order in the column direction to those in each of the row electrode pairs (X, Y) adjacent thereto in the column direction. The row electrodes X of the respective row electrode pairs (X, Y) adjacent to each other are positioned back to back. Similarly, the row electrodes Y of the adjacent row electrode pairs (X, Y) are positioned back to back.

A dielectric layer 2 is deposited on the inner face of the front glass substrate 1 so as to overlie the row electrode pairs (X, Y). Additional dielectric layers (not shown) are deposited on the inner face of the dielectric layer 2 so as to extend out therefrom and extend in the row direction. Each of the additional dielectric layers faces the back-to-back bus electrodes Xb and Yb of the adjacent row electrode pairs (X, Y) and the area between these bus electrodes Xb and Yb.

In turn, a protective layer 4 formed of MgO is deposited on the inner faces of the dielectric layer 2 and the additional dielectric layers (not shown).

The front glass substrate 1 is placed parallel to a back glass substrate 5 at a required interval. A plurality of column electrodes D1(R), D1(G) and D1(B) are deposited on the inner face (facing the display surface of the PDP) of the back glass substrate 5 facing the front glass substrate 1. The column electrodes D1(R), D1(G) and D1(B), each of which extends in the column direction, are spaced at required intervals in the row direction in positions corresponding to the paired transparent electrodes Xa and Ya of the row electrode pairs (X, Y).

The shape of each column electrode D1(R), D1(G), D1(B) will be described later in detail.

A white column-electrode protective layer (dielectric layer) 6 is deposited on the inner face of the back glass substrate 5 so as to cover the column electrodes D1(R), D1(G) and D1(B).

In turn, partition wall units 7 are deposited on the column-electrode protective layer 6.

Each of the partition wall unit 7 is formed in an approximate ladder shape made up of vertical walls 7A and transverse walls 7B. The vertical walls 7A are arranged parallel to each other and each extend in the column direction between the adjacent two column electrodes D1(R)/D1(G)/D1(B). The transverse walls 7B respectively extend in the row direction while facing the bus electrodes Xb and Yb of the row electrodes X and Y.

The partition wall units 7 are regularly arranged parallel to each other in the column direction. An interstice SL is created between the adjacent partition wall units 7. The interstice SL extends in the row direction in correspondence with the area between the back-to-back bus electrodes Xb (or Yb) of the respective row electrode pairs (X, Y).

The partition wall units 7 partition the discharge space defined between the front glass substrate 1 and the back glass substrate 5 into areas respectively corresponding to the paired transparent electrodes Xa and Ya in each row electrode pair (X, Y) to form quadrangular-shaped discharge cells C(R), C(G) and C(B).

A red phosphor layer 8(R) is provided in each of the discharge cells C(R) (the discharge cell C(R) is hereinafter referred to as "the red discharge cell C(R)"). The red phosphor layer 8(R), which is formed of phosphor materials for emitting red visible light, overlies the five faces of the discharge cell C(R), that is, the surface of the column-electrode protective layer 6 and the side faces of the vertical walls 7A and the transverse walls 7B of the partition wall unit 7.

A green phosphor layer 8(*g*) is provided in each of the discharge cells C(G) (the discharge cell C(G) is hereinafter referred to as "the green discharge cell C(G)"). The green phosphor layer 8(G), which is formed of phosphor materials for emitting green visible light, overlies the five faces of the discharge cell C(G), that is, the surface of the column-electrode protective layer 6 and the side faces of the vertical walls 7A and the transverse walls 7B of the partition wall unit 7.

A blue phosphor layer 8(B) is provided in each of the discharge cells C(B) (the discharge cell C(B) is hereinafter referred to as "the blue discharge cell C(B)"). The blue phosphor layer 8(B), which is formed of phosphor materials for emitting blue visible light, overlies the five faces of the discharge cell C(B), that is, the surface of the column-electrode protective layer 6 and the side faces of the vertical walls 7A and the transverse walls 7B of the partition wall unit 7.

The red discharge cell C(R), the green discharge cell C(G) and the blue discharge cell C(B) are arranged in this order in the row direction.

In each case, the column electrode D1(R) faces the red discharge cells C(R) (the column electrode D1(R) is hereinafter referred to as "the red column electrode D1(R)"). Similarly, the column electrode D1(G) faces the green discharge cells C(G) (the column electrode D1(G) is hereinafter referred to as "the green column electrode D(G))"). Similarly, the column electrode D1(B) faces the blue discharge cells C(B) (the column electrode D1(B) is hereinafter referred to as "the blue column electrode D1(B)").

Each of the red, green and blue column electrodes D1(R), D1(G) and D1(B) has widened portions D1(R)a, D1(G)a, D1(B)a respectively corresponding the transparent electrodes Ya of each row electrode Y. The widened portions D1(R)a, D1(G)a and D1(B)a respectively have row-direction widths $W_R$, $W_G$ and $W_B$ which are respectively greater than the row-direction widths $W_r$, $W_g$ and $W_b$ of the other parts, that is, the respective bar-shaped portions D1(R)b, D1(G)b and D1(B)b of the red, green and blue column electrodes D1(R), D1(G) and D1(B).

The widened portions D1(R)a, D1(G)a and D1(B)a of the respective red, green and blue column electrodes D1(R), D1(G) and D1(B) are identical with each other in the row-direction widths $W_R$, $W_G$ and $W_B$, that is, they are set in the relationship $W_R=W_G=W_B$.

The widened portions D1(R)a, D1(G)a and D1(B)a of the red, green and blue column electrodes D1(R), D1(G) and D1(B) respectively have column-direction lengths $L1_R$, $L1_G$ and $L1_B$. The column-direction length $L1_G$ of each of the widened portions D1(G)a of the green column electrode D1(G) is greater than the column-direction length $L1_R$ of each of the widened portions D1(R)a of the red column electrode D1(R) and than the column-direction length $L1_B$ of each of the widened portions D1(B)a of the blue column electrode D1(B). The column-direction length $L1_R$ of the widened portion D1(R)a is equal to the column-direction length $L1_B$ of the widened portion D1(B). That is, the column-direction relationship is $L1_G>L1_R=L1_B$.

Referring FIG. 2, the widened portion D1(G)a of the green column electrode D1(G) is positioned such that the opposing column-direction ends of the widened portion D1(G)a are respectively located beyond the opposing column-direction ends of each of the widened portions D1(R)a and D1(B)a of the red and blue column electrodes D1(R) and D1(B). One of the opposing column-direction ends of the widened portion D1(G)a is located closer to the center of the green discharge cell C(G) so as to be aligned with the discharge gap g.

The column-direction position of the widened portion D1(R)a of the red column electrode D1(R) is aligned in the row direction with the column-direction position of the widened portion D1(B)a of the blue column electrode D1(B). One of the opposing column-direction ends of each of the widened portions D1(R)a and D1(B)a is located closer to the center of the red discharge cell C(R), or the blue discharge cell C(B), so as to be approximately aligned with the leading edge of the transparent electrode Ya of the row electrode Y.

The discharge space defined between the front glass substrate 1 and the back glass substrate 4 is filled with a discharge gas including xenon.

The PDP generates an image in the following steps.

The PDP initiates a reset discharge simultaneously in all discharge cells for the initialization of all the discharge cells. Then, a scan pulse is applied to the row electrodes Y and a data pulse is applied selectively to the red column electrodes D1(R), the green column electrodes D1(G) and the blue column electrodes D1(B), in order to initiate an address discharge between the row electrodes and the red, green and blue column electrodes D1(R), D1(G) and D1(B) to which the date pulse is applied.

In each of the red, green and blue discharge cells C(R), C(G) and C(B) in which the address discharge has been initiated, either wall charges are accumulated on, or the accumulated wall charges are erased from, a portion of the dielectric layer 2 facing the discharge cell. As a result, the light-emission cells (the discharge cells with the wall charges accumulated on the dielectric layer 2) and the non-light-emission cells (the discharge cells without the wall charge on the dielectric layer 2) are distributed over the panel screen in accordance with the image data of the video signal.

After the address discharge, a sustaining pulse is applied alternately to the row electrodes X and Y in each row electrode pair (X, Y). Whenever the sustaining pulse is applied, a sustaining discharge is initiated across the discharge gap g between the paired transparent electrodes Xa and Ya of the row electrodes X and Y in each light-emission cell.

The sustaining discharge results in the generation of vacuum ultraviolet light from the xenon included in the discharge gas filling the light-emission cells. The vacuum ultraviolet light excites the red phosphor layer 8(R), the green phosphor layer 8(G) and the blue phosphor layer 8(B) in the respective light-emission cells, from which the three primary colors, red, green and blue, visible lights are thus emitted so as to form the matrix display image on the panel screen.

In the PDP, the widened portions D1(R)a, D1(G)a and D1(B)a are respectively formed on the red column electrode D1(R), the green column electrodes D1(G) and the blue column electrode D1(B). Because of this, each of the red, green and blue column electrodes D1(R), D1(G) and D1(B) has a greater opposing area to the head end Ya1 of the transparent electrode Ya of the row electrode Y than the opposing area to the base end Ya2 of the transparent electrode Ya. For this reason, in the operation of the PDP as described above, the occurrence of the address discharge is concentrated on the head end Ya1 of the transparent electrode Ya, so that the discharge generation region is prevented from expanding to the inner peripheral area of the discharge cell, resulting in stable discharge characteristics.

In the PDP, the area of the widened portion D1(G)a of the green column electrode D1(G) is greater than the area of each of the widened portions D1(R)a and D1(B)a of the red and blue column electrodes D1(R) and D1(B). For this reason, the discharge voltage during the address discharge can be reduced in the green discharge cell C(G) which is provided with the green phosphor layer 8(G) formed of the green phosphor materials which make the occurrence of a discharge less likely. This makes it possible to set the discharge voltage in the green discharge cell C(G) to be approximately equal to the discharge voltage in each of the red and blue discharge cells C(R) and C(B). In turn, the discharge characteristics are approximately equal in the discharge cells, thus achieving an enhancement in voltage margin of the panel.

In the PDP, in addition, the widened portion D1(G)a of the green column electrode D1(G) has a column-direction length $L1_G$ greater than each of the column-direction lengths $L1_R$ and $L1_B$ of the respective widened portions D1(R)a and D1(B)a of the red and blue column electrodes D1(R) and D1(B). That is, the area of the widened portion D1(G)a is greater than that of each of the widened portions D1(R)a and D1(B)a of the red and blue column electrodes D1(R) and D1(B). As a result, even when the increasing advance of high-definition-image technology such as so-called full HD involves a reduction in the area of each discharge cell, it is possible to avoid the partial overlie between the row-direction opposing ends of the widened portion D1(G)a of the green column electrode D1(G) and the vertical walls 7A of the partition wall units 7 defining this green discharge cell C(G). This makes it possible to prevent an increase in the electrostatic capacity between the row electrode and the column electrode and the elimination of the effect of reducing the discharge voltage which are caused by the partial overlie between the widened portion of the column electrode and the partition wall unit as occurs in a conventional PDP.

In addition, the widened portion D1(G)a of the green column electrode D1(G) of the PDP extends to a position facing the discharge gap g between the paired transparent electrodes Xa and Ya of the row electrodes X and Y than the position of each of the widened portions D1(R)a and D1(B)a of the red and blue column electrodes D1(R) and D1(B), thus achieving a reduction in the discharge voltage during the address discharge in the green discharge cell C(G). In consequence, the discharge voltages in the red discharge cell C(R), the green discharge cell C(G) and the blue discharge cell C(B) during the address discharge can be easily made equal.

The first embodiment has described the case of the green phosphor layer formed of phosphor materials that make it most difficult for the address discharge to occur, but is applicable to a PDP equipped with the red phosphor layer or the blue phosphor layer formed of phosphor materials that make it most difficult for the address discharge to occur.

The first embodiment has described a PDP employing approximately ladder-shaped partition wall units by way of example, but is applicable to a PDP employing any type of the partition wall unit, such as an approximately grid-shaped partition wall unit and partition walls of a striped shape extending in the column direction.

The first embodiment has described a PDP comprising row electrodes each having island-shaped transparent electrodes extending out from the bus electrode in the column direction in individual discharge cells, by way of example, but is applicable to a PDP comprising row electrodes each having a transparent electrode of a striped shape extending in the row direction without separation.

Second Embodiment

Figure 4:
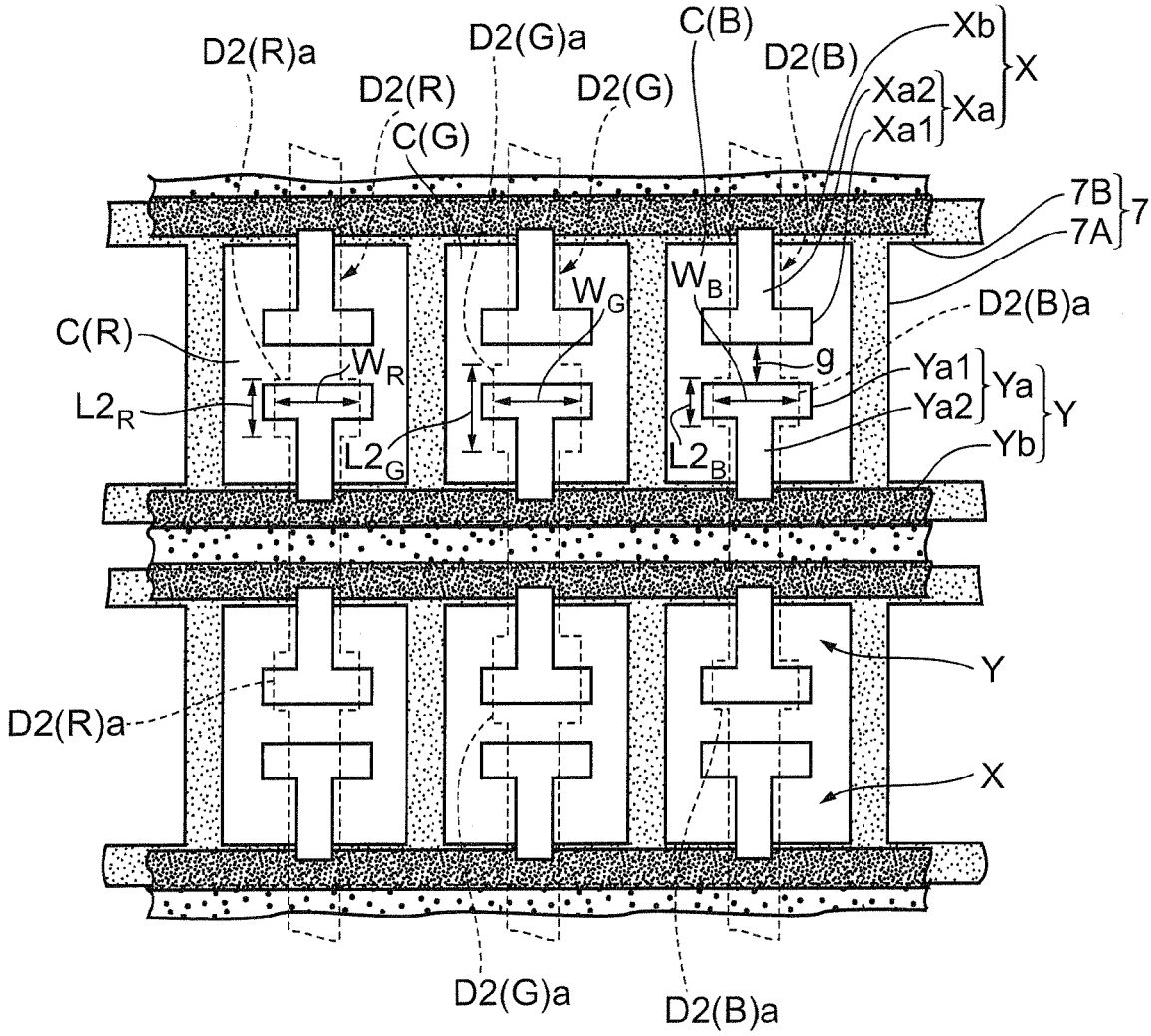
FIG. 4 is a front view illustrating a second embodiment of a PDP according to the present invention.

FIG. 4 is a schematic front view illustrating a PDP of a second embodiment of the present invention.

In the aforementioned PDP in the first embodiment, the area of the widened portion of the green column electrode is larger than that of each of the widened portions of the red and blue column electrodes, and the widened portions of the red and blue column electrodes are identical in area.

By contrast, in the PDP of the second embodiment, the area of a widened portion D2(G)a of a green column electrode D2(G) is larger than that of each of the widened portions D2(R)a and D2(B)a of the red and blue column electrodes D2(R) and D2(B).

In addition to this, the area of the widened portion D2(R)a of the red column electrode D2(R) is greater than the area of the widened portion D2(B)a of the blue column electrode D2(B).

Specifically, the widened portions D2(R)a, D2(G)a and D2(B)a of the red, green and blue column electrodes D2(R), D2(G) and D2(B) are equal in the row-direction width $W_R$, $W_G$ and $W_B$, that is $W_R=W_G=W_B$, but differ in column-direction lengths $L2_R$, $L2_G$, $L2_B$ from each other. The widened portion D2(G)a of the green column electrode D2(G) has the longest column-direction length $L2_G$, and the widened portion D2(B)a of the blue column electrode D2(B) has the shortest column-direction length $L2_B$. In short, $L_G>L_R>L_B$.

The opposing column-direction ends of the widened portion D2(G)a of the green column electrode D2(G) are respectively located beyond the opposing column-direction ends of each of the widened portions D2(R)a and D2(B)a of the red and blue column electrodes D2(R) and D2(B). One of the opposing column-direction ends of the widened portion D2(G)a is located closer to the center of the green discharge cell C(G) so as to be aligned with the discharge gap g.

The discharge-cell-center ends of the column-direction opposing ends of the widened portions D2(R)a and D2(B)a of the red and blue column electrodes D2(R) and D2(B) are located in the same position in the column direction, and are respectively approximately aligned with the leading edge of the transparent electrodes Ya of the row electrode Y.

The structure of the other components of the PDP in the second embodiment is very similar to that of the PDP in the first embodiment, and the same structural components are indicated in FIG. 4 by the same reference numerals as those in the PDP of the first embodiment.

As described in the aforementioned first embodiment, among the phosphor materials forming the phosphor layers provided in the red, green and blue discharge cells C(R), C(G) and C(B), the green phosphor materials forming the green phosphor layer 8(G) provided in the green discharge cell C(G) makes it most difficult for the address discharge to occur through the phosphor layer. In the comparison between the red phosphor materials forming the red phosphor layer 8(R) and the blue phosphor material forming the blue phosphor layer 8(B), the address discharge occurs more easily through the blue phosphor layer 8(B) than through the red phosphor layer 8(R).

To overcome this, in the PDP of the second embodiment, the widened portion D2(G)a of the green column electrode D2(G) has the largest area and the area of the widened portion D2(B)a of the blue column electrode D2(B) is smaller than the area of the widened portion D2(R)a of the red column electrode D2(R).

As a result, the discharge voltage during the address discharge is reduced in the green discharge cell C(G), and the discharge voltage during the address discharge is increased in the blue discharge cell C(B), so that the discharge voltages in the green and blue discharge cells C(G) and C(B) become approximately equal to the discharge voltage during the address discharge in the red discharge cell C(R). In consequence, the discharge characteristics are more equalized in the red, green and blue discharge cells C(R), C(G) and C(B) as compared with the case in the first embodiment, thus more reliably achieving an enhancement in voltage margin of the panel.

The other technical advantageous effects in the PDP of the second embodiment are the same as those in the PDP of the first embodiment.

As in the case of the first embodiment, the present invention is applicable to, as well as a PDP employing approximately ladder-shaped partition wall units as described above, a PDP employing any type of the partition wall unit, such as an approximately grid-shaped partition wall unit and partition walls of a striped shape extending in the column direction. In addition, the present invention is applicable to, as well as a PDP comprising row electrodes each having island-shaped transparent electrodes extending out from the bus electrode in the column direction in individual discharge cells as described above, a PDP comprising row electrodes each having a transparent electrode of a striped shape extending in the row direction without separation.

The second embodiment has described the case of the green phosphor layer formed of phosphor materials that make it most difficult for the address discharge to occur and also the blue phosphor layer formed of phosphor materials that make it easiest for the address discharge to occur, byway of example. However, the present invention is not limited to this example, and as a column electrode faces the discharge cell provided with a phosphor layer making it more and more difficult for the address discharge to occur, a widened portion of the column electrode has a larger and larger area.

Third Embodiment

Figure 5:
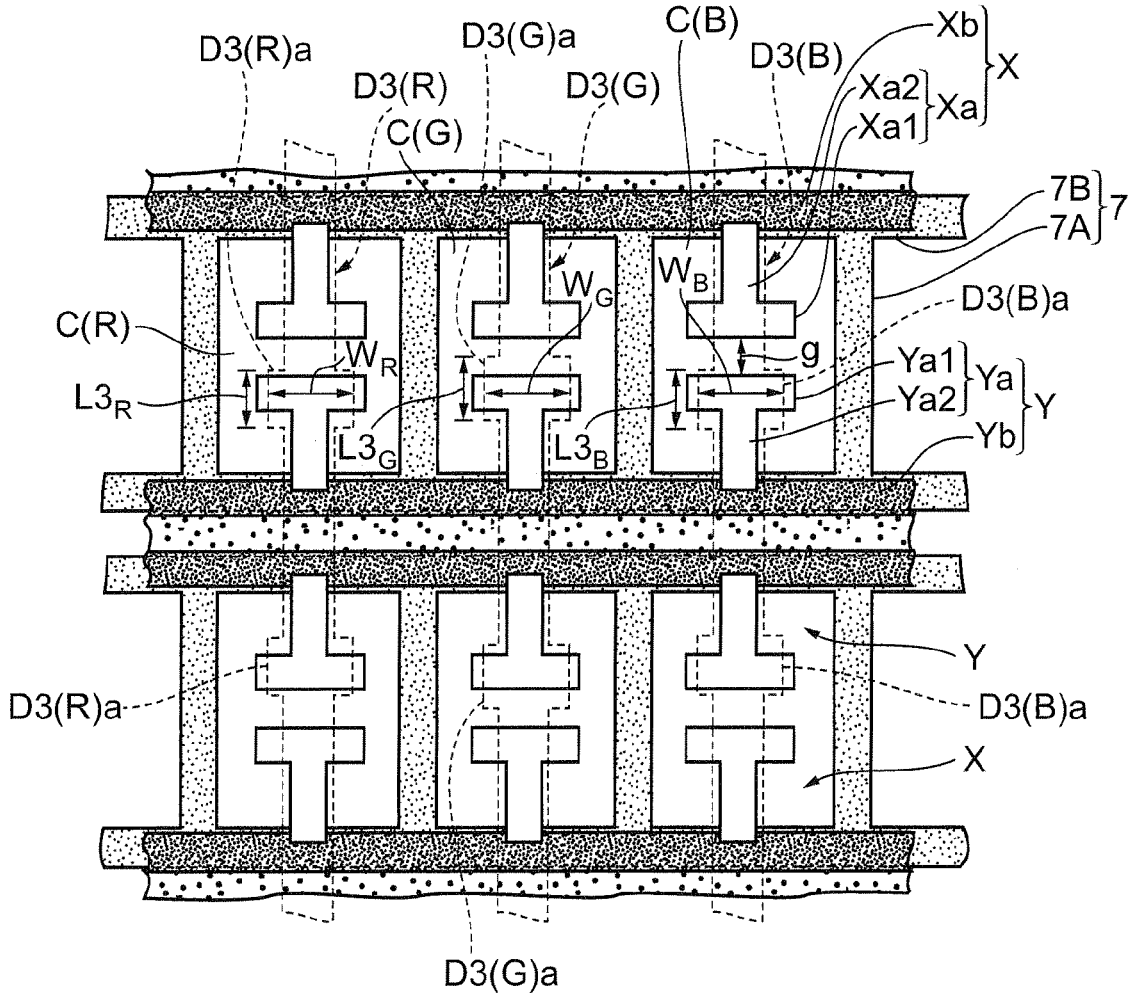
FIG. 5 is a front view illustrating a third embodiment of a PDP according to the present invention.

FIG. 5 is a schematic front view illustrating a PDP of a third embodiment of the present invention.

In the PDP described in the first embodiment, the area of the widened portion of the green column electrode is larger than the area of each of the widened portions of the red and blue column electrodes.

By contrast, in the PDP of the third embodiment, the widened portions D3(R)a, D3(G)a and D3(B)a of the respective red, green and blue column electrodes D3(R), D3(G) and D3(B) have equal row-direction widths $W_R$, $W_G$ and $W_B$, and equal column-direction lengths $L3_R$, $L3_G$ and $L3_B$ to each other ($W_R=W_G=W_B$, $L3_R=L3_G=L3_B$) so as to be identical in area.

The widened portion D3(G)a of the green column electrode D3(G) is located closer to a position facing the center of the green discharge cell C(G) in the column direction than the positions of the respective widened portions D3(R)a and D3(B)a of the red and blue column electrodes D3(R) and D3(B) in the red and blue discharge cells C(R) and C(B). The end of the widened portion D3(G)a of the green column electrode D3(G) positioned closer to the center of the green discharge cell C(G) faces the discharge gap g between the paired transparent electrodes Xa and Ya.

One ends of the widened portions D3(R)a and D3(B)a of the red and blue column electrodes D3(R) and D3(B), which are respectively located in the same positions closer to the centers of the red and blue discharge cells in the column direction, are respectively, approximately aligned with the head edges of the transparent electrodes Ya of the row electrodes Y in the red and blue discharge cells.

The structure of the other components of the PDP in the third embodiment is very similar to that of the PDP in the first embodiment, and the same structural components are indicated in FIG. 5 by the same reference numerals as those in the PDP of the first embodiment.

In the PDP, the widened portions D3(R)a, D3(G)a and D3(B)a respectively facing the transparent electrodes Ya of the row electrodes Y are respectively formed on the red column electrode D3(R), the green column electrodes D3(G) and the blue column electrode D3(B). For this reason, in the operation of the PDP, the occurrence of the address discharge is concentrated on the head end Ya1 of the transparent electrode Ya, so that the discharge generation region is prevented from expanding to the inner peripheral area of the discharge cell, resulting in stable discharge characteristics.

In addition, the widened portion D3(G)a of the green column electrode D3(G) of the PDP is located closer to a position facing the discharge gap g between the paired transparent electrodes Xa and Ya of the row electrodes X and Y than the position of each of the widened portions D3(R)a and D3(B)a of the red and blue column electrodes D3(R) and D3(B), so as to face the discharge gap g. Because of this arrangement, a reduction in the discharge voltage during the address discharge in the green discharge cell C(G) is achieved. In consequence, the discharge voltage during the address discharge in the green discharge cell C(G), in which the green phosphor layer is provided and formed of green phosphor materials that make it more difficult for the address discharge to occur than the red and blue phosphor materials do, can be approximately equal to the discharge voltages during the address discharge in the red discharge cell C(R) and the blue discharge cell C(B). In turn, the discharge characteristics are approximately equal in the discharge cells, thus achieving an enhancement in voltage margin of the panel.

In addition, in the PDP, each of the widened portions D3(G)a of the green column electrode D3(G), which has the same area as that of each of the widened portions D3(R)a and D3(B)a of the red and blue column electrodes D3(R) and D3(B), is located closer to a position facing the center of the discharge cell C(G) in the column direction than the positions of the widened portions D3(R)a and D3(B)a of the red and blue column electrodes D3(R) and D3(B) in the respective discharge cells in the column direction. The end of this widened portion D3(G)a located closer to the center of the green discharge cell C(G) faces the discharge gap g between the paired transparent electrodes Xa and Ya. For this reason, the discharge voltage during the address discharge is reduced in the green discharge cell C(G) to be approximately equal to the discharge voltage during the address discharge in each of the red and blue discharge cells C(R) and C(B). As a result, even when the increasing advance of high-definition-image technology such as so-called full HD involves a reduction in the area of each discharge cell, it is possible to avoid the partial overlie between the row-direction opposing ends of the widened portion D3(G)a of the green column electrode D3(G) and the vertical walls 7A of the partition wall units 7 defining this green discharge cell C(G) as done in a conventional PDP. This makes it possible to prevent an increase in the electrostatic capacity between the row electrode and the column electrode and the elimination of the effect of reducing the discharge voltage which are caused by the partial overlie between the widened portion of the column electrode and the partition wall unit as occurs in a conventional PDP.

The other technical advantageous effects in the PDP of the third embodiment are the same as those in the PDP of the first embodiment.

As in the case of the first embodiment, the present invention is applicable to, as well as a PDP employing approximately ladder-shaped partition wall units as described above, a PDP employing any type of the partition wall unit, such as an approximately grid-shaped partition wall unit and partition walls of a striped shape extending in the column direction. In addition, the present invention is applicable to, as well as a PDP comprising row electrodes each having island-shaped transparent electrodes extending out from the bus electrode in the column direction in individual discharge cells as described above, a PDP comprising row electrodes each having a transparent electrode of a striped shape extending in the row direction without separation.

The foregoing has described the example of the widened portion D3(R)a of the red column electrode D3(R) and the widened portion D3(B)a of the blue column electrode D3(B) being located in the same positions in the respective discharge cells in the column direction. Alternatively, in the blue discharge cell C(B) having the blue phosphor layer formed of the blue phosphor materials that make the discharge more readily occur than the red phosphor materials make, the widened portion of the column electrode may be positioned closer to the base end of the transparent electrode Ya of the row electrode as compared with the position of the widened portion of the red column electrode in the red discharge cell C(R). This makes it possible to further equalize the discharge voltage during the address discharge in the red, green and blue discharge cells C(R), C(G) and C(B).

The third embodiment has described the case of the green phosphor layer formed of phosphor materials that make it most difficult for the address discharge to occur, by way of example. However, the present invention is not limited to this example, and as a column electrode faces the discharge cell provided with a phosphor layer making it more and more difficult for the address discharge to occur, a widened portion of the column electrode is located closer and closer to a position facing the center of the discharge cell.

In a basic idea of the PDP described in the aforementioned embodiments, a plasma display panel comprises front and back substrates facing each other across a discharge space, a plurality of row electrode pairs that each extend in a row direction and are arranged in column direction on a rear-facing face of the front substrate and each of which is constituted of a pair of row electrodes facing each other across a discharge gap, a plurality of column electrodes which each extend in the column direction and are arranged in the row direction on a face of the back substrate facing the front substrate and form unit light emission areas in the discharge space in positions respectively corresponding to the intersections with the row electrode pairs, and phosphor layers respectively provided in the unit light emission areas for emitting light of different colors, wherein each of the column electrodes has widened portions of a row-direction width wider than that of the other portions, each of the widened portions faces a head portion of one of the pair of row electrodes constituting each row electrode pair, the head portion facing the other row electrode with the discharge gap in between, the widened portion of the column electrode, that faces the unit light emission area of the unit light emission areas in which the phosphor layer is provided for emitting light of a required color, is located in a different position in the column direction from the position of another widened portion of another column electrode facing another unit light emission area in which the phosphor layer is provided for emitting light of a different color from the required color.

In the PDP of the embodiment based on the basic idea, the widened portions are provided on each of the column electrodes. Because of this, the column electrode has an increased opposing area to the head end of one of the row electrode pair facing the other row electrode with the discharge gap in between. For this reason, in the operation of the PDP, when an address discharge is initiated between one of the paired row electrodes and the column electrode, the occurrence of the address discharge is concentrated on a central portion of the unit light emission area corresponding to the discharge gap between the row electrodes, so that the discharge generation region is prevented from expanding to the inner peripheral area of the unit light emission area, resulting in stable discharge characteristics.

In addition, the phosphor layers of different colors, for example, the red, green and blue phosphor layers are respectively provided in the unit light emission areas. An address discharge occurs through the phosphor layer interposed between the row and column electrodes. Then, when one of the phosphor layers having a required color, for example, the green phosphor layer for emitting green light, is formed of phosphor materials that make the occurrence of the address discharge less likely than the phosphor layers for emitting light of the other colors make, the widened portion of the column electrode facing the unit light emission area in which the phosphor layer for emitting the required color light is provided is located in a different position in the column direction from the position of another widened portion of the column electrode facing another unit light emission area in which the phosphor layer is provided for emitting light of a different color from the required color.

Accordingly, the widened portion of the column electrode, which faces the unit light emission area equipped with the phosphor layer emitting light of the color making the occurrence of the address discharge less likely, can be located in a position allowing the address discharge to occur more readily than the widened portion of the column electrode facing the unit light emission areas for the other color light emission. In consequence, the discharge voltage during the address discharge initiated in the unit light emission area in which the phosphor layer making the occurrence of the address discharge less likely is reduced to be approximately equal to the discharge voltage in the other unit light emission areas for the other color light emission. In consequence, the discharge characteristics are equalized in the respective unit light emission areas, thus reliably achieving an enhancement in voltage margin of the panel.

The terms and description used herein are set forth by way of illustration only and are not meant as limitations. Those skilled in the art will recognize that numerous variations are possible within the spirit and scope of the invention as defined in the following claims.

What is claimed is:

1. A plasma display panel, comprising:

a front substrate and a back substrate facing each other across a discharge space;

a plurality of row electrode pairs each extending in a row direction and arranged in column direction on a rear-facing face of the front substrate, each of the row electrode pairs being constituted of a pair of row electrodes facing each other across a discharge gap;

a plurality of column electrodes each extending in the column direction and arranged in the row direction on a face of the back substrate facing the front substrate, and forming unit light emission areas in the discharge space in positions respectively corresponding to intersections with the row electrode pairs; and phosphor layers respectively provided in the unit light emission areas for emitting light of different colors, wherein each of the column electrodes has widened portions of a row-direction width larger than that of the other portions, and each of the widened portions faces a head portion of one of the pair of row electrodes constituting each row electrode pair, the head portion facing the other row electrode with the discharge gap in between, the widened portion of the column electrode, that faces the unit light emission area of the unit light emission areas in which the phosphor layer emitting light of a required color is provided, is located in a different position in the column direction of the head portion of one of the corresponding row electrode pair facing the other row electrode with the discharge gap in between from a position of another widened portion of another column electrode facing another unit light emission area in which the phosphor layer is provided for emitting light of a different color from the required color; and wherein a column-direction width of the widened portion of the column electrode facing the unit light emission area in which the phosphor layer emitting the light of the required color is provided is larger than a column-direction width of the widened portion of the column electrode facing the unit light emission area in which the phosphor layer emitting the light of a different color from the required color is provided.

2. A plasma display panel, comprising:

a front substrate and a back substrate facing each other across a discharge space;

a plurality of row electrode pairs each extending in a row direction and arranged in column direction on a rear-facing face of the front substrate, each of the row electrode pairs being constituted of a pair of row electrodes facing each other across a discharge gap;

a plurality of column electrodes each extending in the column direction and arranged in the row direction on a face of the back substrate facing the front substrate, and forming unit light emission areas in the discharge space in positions respectively corresponding to intersections with the row electrode pairs; and phosphor layers respectively provided in the unit light emission areas for emitting light of different colors, wherein each of the column electrodes has widened portions of a row-direction width larger than that of the other portions, and each of the widened portions faces a head portion of one of the pair of row electrodes constituting each row electrode pair, the head portion facing the other row electrode with the discharge gap in between, the widened portion of the column electrode, that faces the unit light emission area of the unit light emission areas in which the phosphor layer emitting light of a required color is provided, is located in a different position in the column direction of the head portion of one of the corresponding row electrode pair facing the other row electrode with the discharge gap in between from a position of another widened portion of another column electrode facing another unit light emission area in which the phosphor layer is provided for emitting light of a different color from the required color; and wherein, as the column electrode faces the unit light emission area provided with the phosphor layer formed of phosphor materials that make it more and more difficult for a discharge to occur through the phosphor layer between the row electrode and the column electrode, the widened portion of the column electrode has a wider column-direction width.

3. A plasma display panel, comprising:

a front substrate and a back substrate facing each other across a discharge space;

a plurality of row electrode pairs each extending in a row direction and arranged in column direction on a rear-facing face of the front substrate, each of the row electrode pairs being constituted of a pair of row electrodes facing each other across a discharge gap;

a plurality of column electrodes each extending in the column direction and arranged in the row direction on a face of the back substrate facing the front substrate, and forming unit light emission areas in the discharge space in positions respectively corresponding to intersections with the row electrode pairs; and phosphor layers respectively provided in the unit light emission areas for emitting light of different colors, wherein each of the column electrodes has widened portions of a row-direction width larger than that of the other portions, and each of the widened portions faces a head portion of one of the pair of row electrodes constituting each row electrode pair, the head portion facing the other row electrode with the discharge gap in between, the widened portion of the column electrode, that faces the unit light emission area of the unit light emission areas in which the phosphor layer emitting light of a required color is provided is located in a different position in the column direction of the head portion of one of the corresponding row electrode pair facing the other row electrode with the discharge gap in between from a position of another widened portion of another column electrode facing another unit light emission area in which the phosphor layer is provided for emitting light of a different color from the required color;

wherein the phosphor layers are formed of phosphor materials emitting light of red, green and blue colors from the respective unit light emission areas, the widened portion of the column electrode facing the unit light emission area in which the phosphor layer emitting the green light is provided is located in a different position in the column direction from positions of the widened portions of the column electrodes respectively facing the unit light emission areas in which the phosphor layers respectively formed of the phosphor materials emitting the red and blue lights are respectively provided; and wherein the widen portion of the column electrode facing the unit light emission area in which the phosphor layer formed of the phosphor materials emitting the blue light is provided is located close to a position facing the center of the unit light emission area, the widen portion of the column electrode facing the unit light emission area in which the phosphor layer formed of the phosphor materials emitting the red light is provided is located closer to a position facing the center of the unit light emission area, and the widen portion of the column electrode facing the unit light emission area in which the phosphor layer formed of the phosphor materials emitting the green light is provided is located closest to a position facing the center of the unit light emission area.

4. A plasma display panel, comprising:

a front substrate and a back substrate facing each other across a discharge space;

a plurality of row electrode pairs each extending in a row direction and arranged in column direction on a rear-facing face of the front substrate, each of the row electrode pairs being constituted of a pair of row electrodes facing each other across a discharge gap;

a plurality of column electrodes each extending in the column direction and arranged in the row direction on a face of the back substrate facing the front substrate, and forming unit light emission areas in the discharge space in positions respectively corresponding to intersections with the row electrode pairs; and phosphor layers respectively provided in the unit light emission areas for emitting light of different colors, wherein each of the column electrodes has widened portions of a row-direction width larger than that of the other portions and each of the widened portions faces a head portion of one of the pair of row electrodes constituting each row electrode pair, the head portion facing the other row electrode with the discharge gap in between, the widened portion of the column electrode, that faces the unit light emission area of the unit light emission areas in which the phosphor layer emitting light of a required color is provided, is located in a different position in the column direction of the head portion of one of the corresponding row electrode pair facing the other row electrode with the discharge gap in between from a position of another widened portion of another column electrode facing another unit light emission area in which the phosphor layer is provided for emitting light of a different color from the required color wherein the phosphor layers are formed of phosphor materials emitting light of red, green and blue colors from the respective unit light emission areas, the widened portion of the column electrode facing the unit light emission area in which the phosphor layer emitting the green light is provided is located in a different position in the column direction from positions of the widened portions of the column electrodes respectively facing the unit light emission areas in which the phosphor layers respectively formed of the phosphor materials emitting the red and blue lights are respectively provided; and wherein a column-direction width of the widened portion of the column electrode facing the unit light emission area in which the phosphor layer formed of the phosphor materials emitting the green light is provided is larger than a column-direction width of each of the widened portions of the column electrodes respectively facing the unit light emission areas in which the phosphor layers formed of the phosphor materials emitting the red and green lights are respectively provided.

5. A plasma display panel, comprising:

a front substrate and a back substrate facing each other across a discharge space;

a plurality of row electrode pairs each extending in a row direction and arranged in column direction on a rear-facing face of the front substrate, each of the row electrode pairs being constituted of a pair of row electrodes facing each other across a discharge gap;

a plurality of column electrodes each extending in the column direction and arranged in the row direction on a face of the back substrate facing the front substrate, and forming unit light emission areas in the discharge space in positions respectively corresponding to intersections with the row electrode pairs; and phosphor layers respectively provided in the unit light emission areas for emitting light of different colors, wherein each of the column electrodes has widened portions of a row-direction width larger than that of the other portions, and each of the widened portions faces a head portion of one of the pair of row electrodes constituting each row electrode pair, the head portion facing the other row electrode with the discharge gap in between, the widened portion of the column electrode, that faces the unit light emission area of the unit light emission areas in which the phosphor layer emitting light of a required color is provided, is located in a different position in the column direction of the head portion of one of the corresponding row electrode pair facing the other row electrode with the discharge gap in between from a position of another widened portion of another column electrode facing another unit light emission area in which the phosphor layer is provided for emitting light of a different color from the required color;

wherein the phosphor layers are formed of phosphor materials emitting light of red, green and blue colors from the respective unit light emission areas, the widened portion of the column electrode facing the unit light emission area in which the phosphor layer emitting the green light is provided is located in a different position in the column direction from positions of the widened portions of the column electrodes respectively facing the unit light emission areas in which the phosphor layers respectively formed of the phosphor materials emitting the red and blue lights are respectively provided; and wherein the widen portion of the column electrode facing the unit light emission area in which the phosphor layer formed of the phosphor materials emitting the green light is provided has a larger column-direction width, the widen portion of the column electrode facing the unit light emission area in which the phosphor layer formed of the phosphor materials emitting the red light is provided has a smaller column-direction width, and the widen portion of the column electrode facing the unit light emission area in which the phosphor layer formed of the phosphor materials emitting the blue light is provided has a smallest column-direction width.

* * * * *